US006365992B1

(12) United States Patent
Yang

(10) Patent No.: US 6,365,992 B1
(45) Date of Patent: Apr. 2, 2002

(54) CHANGEABLE POWER SENSING SWITCH

(76) Inventor: Chueh-Ming Yang, 2F, No.60, Heng Hsi Rd., SanHsia Town, Taipei (TW)

( * ) Notice: Subject to any disclaimer, the term of this patent is extended or adjusted under 35 U.S.C. 154(b) by 0 days.

(21) Appl. No.: 09/500,792

(22) Filed: Feb. 10, 2000

(51) Int. Cl.[7] ..... H01H 35/00
(52) U.S. Cl. ..... 307/116; 307/139
(58) Field of Search ..... 307/116, 139, 307/125, 112, 113

(56) References Cited

U.S. PATENT DOCUMENTS 5,453,593 A * 9/1995 Seok-Yong et al. ..... 219/69.18
5,630,664 A * 5/1997 Farrelly ..... 600/508
6,154,675 A * 11/2000 Juran et al. ..... 607/29

* cited by examiner

*Primary Examiner*—Peter S. Wong
*Assistant Examiner*—Lawrence Luk
(74) *Attorney, Agent, or Firm*—Troxell Law Office PLLC

(57) ABSTRACT

A changeable power sensing switch includes a sensor, a process actuating circuit and an output control port for detecting and sensing different external signals and triggering a work unit to perform work desired. The sensor sensitivity may be adjust to suit different dielectric medium and sensing distance. The switch is more versatile and has wider applications than conventional mechanical switch.

5 Claims, 4 Drawing Sheets

CHANGEABLE POWER SENSING SWITCH

FIELD OF THE INVENTION

This invention relates to a changeable power sensing switch that uses a sensor switch to sense and receive an external control signal and processes and output signal to actuate a work unit.

BACKGROUND OF THE INVENTION

Conventional power switches are mostly mechanical type that transmit an actuating signal to trigger a work unit to perform action required such as lighting a lamp, igniting a fire and the like.

FIG. 1 shows a conventional power switch 1 which includes a face plate 2 in which a plurality of switches (such as a first switch 3, a second switch 4, a third switch 5) are located. In the switches, there are respectively a first indication light 30, a second indication light 40 and a third indication light 50. The face plate 2 further has a plurality of snap hooks 6 for positioning and may be fixed on a wall or selected location by means of screws 7.

Besides the mechanical type switch, there are also metallic touch sensing switch, photoelectronic sensing switch, audio sensing switch, infrared light sensing switch, ultrasonic sensing switch and the like. They also have structural limitation and limit range of sensing signal.

All of the conventional switches set forth above have restriction in size, appearance and operation mode. Each type of switch has its functional and application limitation.

SUMMARY OF THE INVENTION

It is an object of this invention to provide a changeable power sensing switch that has a sensor and control circuits to detect a wide range of external signals and to actuate different kind of work unit to perform a variety of output desired for enhancing the design versatility and functional practicality.

Accordingly to this invention, the switch may include a sensor and an actuating circuit for receiving and processing signals, and output signal through an output control unit. The switch may also include a power source to drive all elements in the switch. The switch may further include a control circuit for adjusting sensor parameters to get optimal sensitivity to detect and receive a wide range of external signals. The switch may include light emission elements for indicating working condition.

DETAILED DESCRIPTION OF THE PREFERRED EMBODIMENT

Figure 1:
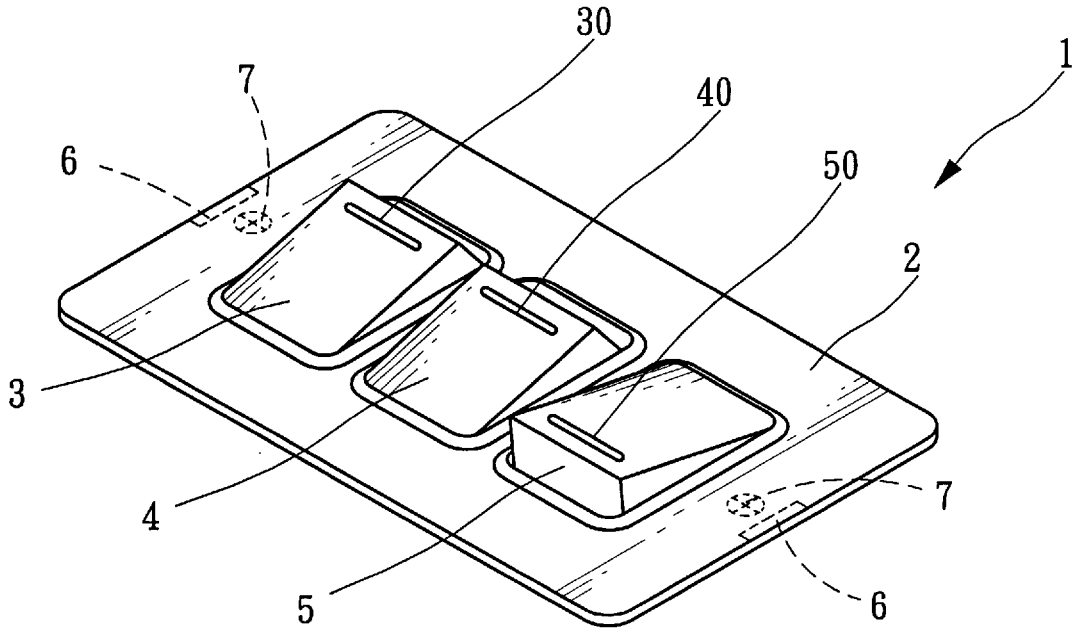
FIG. 1 (PRIOR ART)
FIG. 1 is a perspective view of a conventional mechanical power switch.
Figure 2:
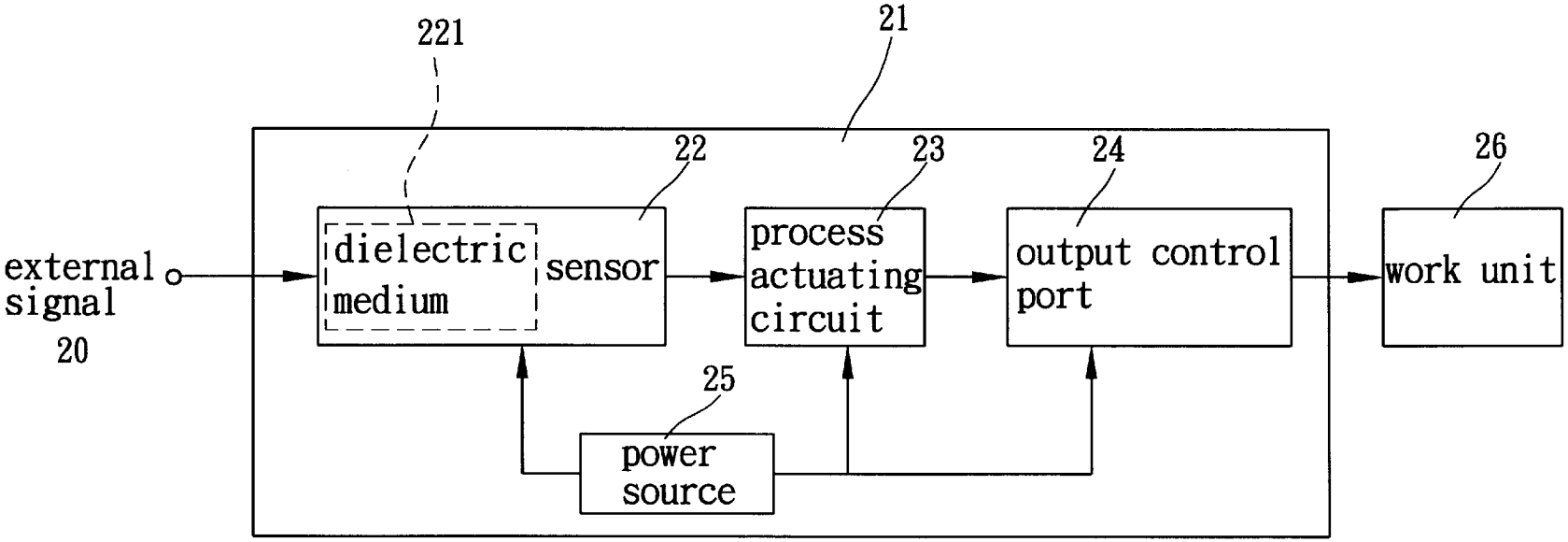
FIG. 2 is a structural block diagram of a first embodiment of this invention.

Referring to FIG. 2, the sensing switch 21 of this invention includes a sensor 22 for receiving an external signal 20, a process actuating circuit 23 to process the signal received from the sensor 22, an output control portion 24 for receiving the control signal from the circuit 23 and sending an output signal to a work unit 26 to perform work desired. The switch 21 may also include a power source 25 to drive all the elements located in the switch 21.

The sensor 22 may further sense the external signal 20 through a dielectric medium 221. Different dielectric medium at different distance may trigger the sensor 22 to generate different type of signal. The work unit 26 may be in many different forms desired such as a fluorescent light, a lamp and the like.

Figure 3:
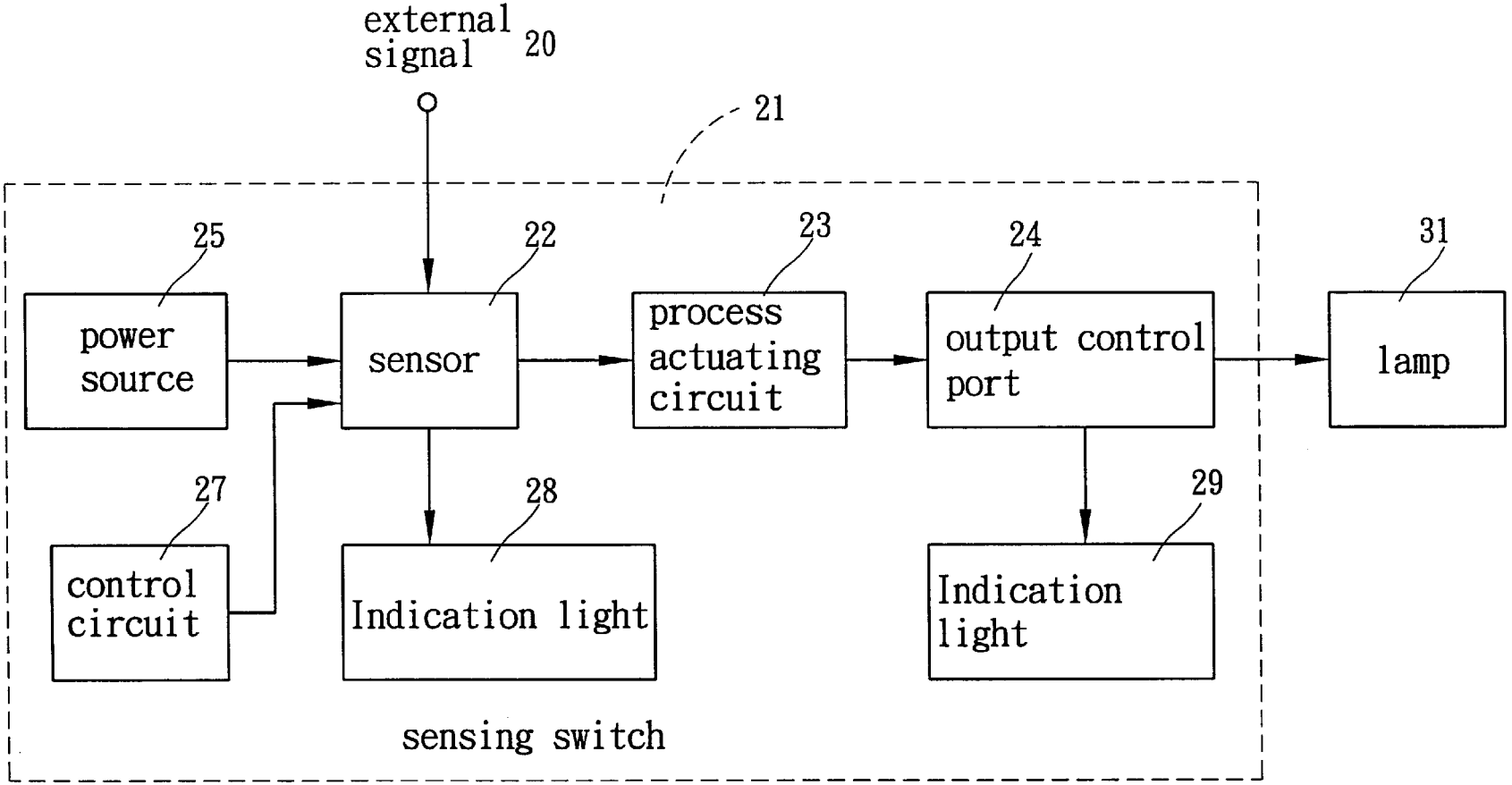
FIG. 3 is a structural block diagram of a second embodiment of this invention.

FIG. 3 shows another embodiment of this invention. Like the one shown in FIG. 2, the switch 21 also has a sensor 22, a process actuating circuit 23, an output control port 24, a power source 25 for receiving and processing an external signal 20 and to trigger an work unit 31 (a lamp in this case). In addition, there is a control circuit 27 for adjusting sensitivity parameters of the sensor 22 so that the sensor 22 may obtain optimal sensing results in accordance with different type of external signal 20. There may also include a first indication light 28 linking to the sensor 22 for indicating sensing status.

The output control port 24 may also link with a second indication light 29 to show working condition or the location of the switch 21. The indication light 28 and 29 may include a plurality of light emission elements. The sensor 22 may also sense external signal 20 through a dielectric medium. Therefore different type of dielectric medium at different distance may induce the sensor 22 to generate different signal to further expand the applicability.

Figure 4:
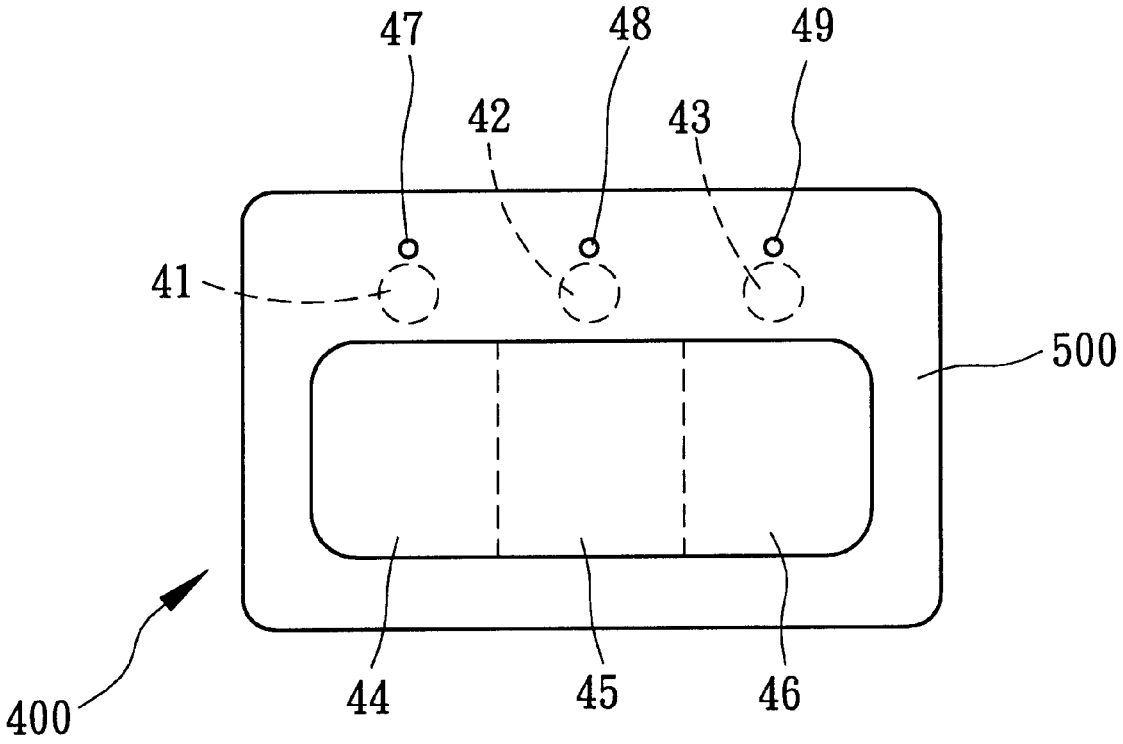
FIG. 4 is a top view of a third embodiment of this invention.

FIG. 4 is a further embodiment of this invention. The sensing switch 400 includes a plurality of sensors (in the case, a first sensor 41, a second sensor 42, and a third sensor 43). Each sensor has a mating indication light (i.e., a first light 44 for sensor 41, a second light 45 for sensor 42, and a third light 46 for sensor 43) for indicating working condition.

Each sensor further may have a display unit for showing sensing status (such as a first display unit 47 for sensor 41, a second display unit 48 for sensor 42 and a third display unit 49 for sensor 43). The switch 400 has a cover plate 500 to protect the sensors.

By means of this invention, the switch may be controlled and tuned to sense a vide variety of external signals with great sensitivity and to trigger a wide scope of work units to perform different applications desired.

It may thus be seen that the objects of the present invention set forth herein, a well as those made apparent from the foregoing description, are efficiently attained. While the preferred embodiments of the invention have been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A changeable power sensing switch for receiving and processing an external signal to actuate lighting of a lamp, comprising:

a dielectric medium sensor to receive the external signal and transmit the received signal to a first indication light;

a process actuating circuit to process the signal transmitted from the sensor;

an output control port receiving an actuating signal from the process actuating circuit and triggering lighting of the lamp and a second indication light;

a power source to provide power needed for running the power sensing switch; and a control circuit for controlling sensitivity adjustment of the sensor.

2. The changeable power sensing switch of claim 1, wherein the dielectric medium is made of a selected material and has a distance to the sensor for the sensor to induce a sensing result from the external control signal.

3. The changeable power sensing switch of claim 1, wherein the control circuit has a control unit for adjusting sensor sensitivity responding to the dielectric medium and sensing distance.

4. The changeable power sensing switch of claim 1, wherein the first indication light includes a plurality of light emission elements for indicating signal transmission of the sensor.

5. The changeable power sensing switch of claim 1, wherein the second indication light includes a plurality of light emission elements for indicating signal transmission of the output control unit.

* * * * *